US005299747A

United States Patent [19]

Satomi

[11] Patent Number: 5,299,747

[45] Date of Patent: Apr. 5, 1994

[54] PAPER MATERIAL SCREENING/REFINING APPARATUS

[75] Inventor: Hitoshi Satomi, Shizuoka, Japan

[73] Assignee: Satomi Seisakusho Co., Ltd., Shizuoka, Japan

[21] Appl. No.: 874,027

[22] Filed: Apr. 27, 1992

[30] Foreign Application Priority Data

Nov. 26, 1991 [JP] Japan ..... 311099

[51] Int. Cl.[5] ..... B02C 25/00

[52] U.S. Cl. ..... 241/46.17; 241/74; 241/80; 241/97

[58] Field of Search ..... 241/46.17, 74, 97, 80, 241/86.1; 162/251, 261, 35

[56] References Cited

U.S. PATENT DOCUMENTS

| | | | |
|---|---|---|---|
| 2,452,135 | 10/1948 | Lowe | 241/46.17 |
| 2,480,085 | 8/1949 | Mitchell | 241/74 |
| 3,188,942 | 6/1965 | Wandel | 241/46.17 X |
| 4,009,834 | 3/1977 | Hahn et al. | 241/74 X |
| 4,108,385 | 8/1978 | Funk | 241/46.17 |
| 4,624,418 | 11/1986 | Szkaradek | 241/46.17 |
| 4,634,059 | 1/1987 | Bähr et al. | 241/97 X |
| 4,838,995 | 6/1989 | Klauser | 162/251 X |
| 4,941,970 | 7/1990 | Ahs | 241/46.17 X |
| 4,991,720 | 2/1991 | Höglund et al. | 241/46.17 X |
| 5,051,168 | 9/1991 | Hautab | 162/261 X |

FOREIGN PATENT DOCUMENTS

| | | | |
|---|---|---|---|
| 671034 | 9/1963 | Canada | 162/261 |
| 684907 | 4/1964 | Canada | 162/261 |
| 2479296 | 10/1981 | France | 162/261 |
| 489592 | 8/1992 | Japan . | |
| 1183591 | 10/1985 | U.S.S.R. | 162/251 |
| 1361217 | 12/1987 | U.S.S.R. | 162/251 |

*Primary Examiner*—Timothy V. Eley
*Assistant Examiner*—Frances Chin
*Attorney, Agent, or Firm*—Kanesaka & Takeuchi

[57] ABSTRACT

A paper material screening and refining apparatus has a tank which receives a paper material to allow the paper material to accumulate therein; a cylindrical screen which divides the space in the tank into a primary chamber and a secondary chamber; a cylindrical rotary member carried by a rotary shaft and disposed so as to oppose to the screen; a rotational member carried by the rotary shaft and disposed near the end of the tank remote from the paper material receiving end of the tank; a water supply pipe for supplying water into the primary chamber from the region near the rotational member; a water supply valve provided in the water supply pipe; a discharge pipe for discharging the paper material in the primary chamber of the tank from a region near the rotational member; and a discharge valve provided in the discharge pipe. Water is introduced into the primary chamber from a region near the rotational member, so as to dilute the material liquid or slurry and to provide a state resembling "scrambling washing" as a result of collision between the introduced water and the paper material, thus promoting dissociation of the paper material, whereby the paper material is efficiently screened and refined by the screen.

9 Claims, 2 Drawing Sheets

PAPER MATERIAL SCREENING/REFINING APPARATUS

BACKGROUND OF THE INVENTION

1. Field of the Invention

The present invention relates to an apparatus for screening and refining a paper material and, more particularly, to an improvement in the paper material screening/refining apparatus for attaining higher screening/refining efficiency in a tank of the apparatus.

2. Description of the Related Art

A typical conventional paper screening/refining apparatus has a tank, wherein a space is divided by a screen into a primary chamber and a secondary chamber, and a rotary member which is disposed in the primary chamber so as to oppose the screen. This known apparatus is disclosed in the specification of Japanese Utility Model Application No. 2-16466.

In the operation of this known paper material refining apparatus, a residue generally referred to as "tail" remains without being passed through the screen. The tail contains a useful paper material so that the tail has to be treated again by a reject screen which is different from the firstmentioned screen.

SUMMARY OF THE INVENTION

An object of the present invention is to overcome the above-described problem of the prior art, by providing a paper material screening/refining apparatus in which the amount of useful paper material which undesirably remains without being passed through the screen is decreased, thereby improving refining efficiency.

In the paper material screening/refining apparatus of the present invention, the paper material is refined between a cylindrical rotary member and a cylindrical screen, such that the density or thickness of the material liquid or slurry increases towards the rotary member. In one form of the invention, when a water supply valve is opened while a discharge valve is closed, water is introduced through a water supply pipe into the primary chamber in the tank from a primary side, so that the material slurry in the region near the screen is diluted by water. In addition, water introduced into the primary chamber of the tank collides with the paper material introduced by the rotary member so as to provide a state like "scrambling washing" so as to promote dissociation of the paper material. In another form of the present invention, a water supply valve and a recirculation valve are opened, while the discharge valve is closed, so that water supplied from the water supply pipe is introduced into the primary chamber inside the tank to dilute the slurry. At the same time, the diluted slurry is recirculated through a recirculation path, so as to be repeatedly stirred to promote dissociation.

DESCRIPTION OF THE PREFERRED EMBODIMENTS

Preferred embodiments of the present invention will be described with reference to the accompanying drawings.

Figure 1:
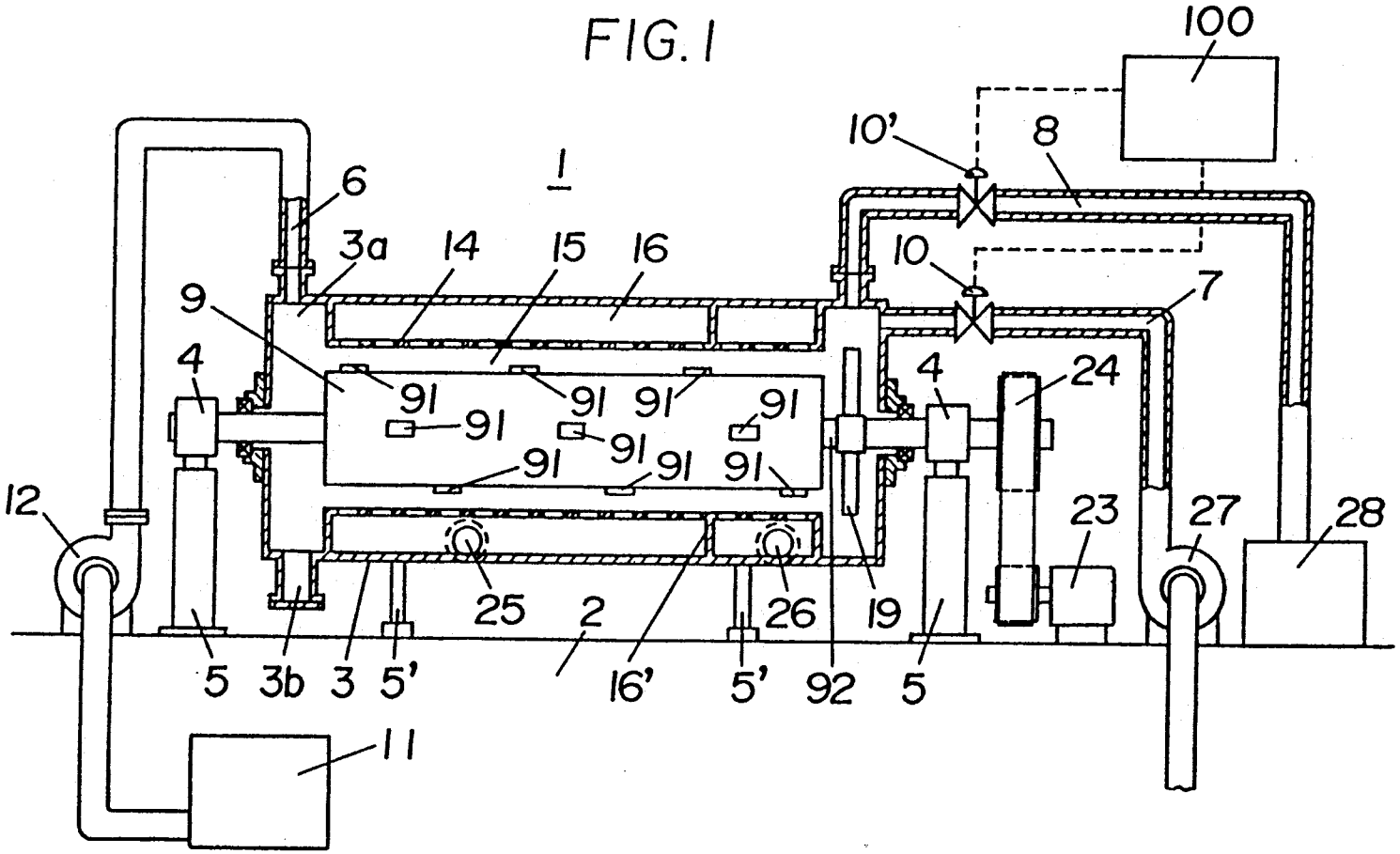
FIG. 1 is a partly-sectioned schematic illustration of an embodiment of the paper material refining apparatus in accordance with, the present invention.

Referring first to FIG. 1 showing the first embodiment of the present invention, a paper material screening/refining apparatus of the present invention, generally designated at numeral 1, is of a pressure-type with a reject discharge function, and has a dissociation power. The paper material refining apparatus has legs 5 situated on a bed 2 and supporting bearings 4. Numeral 5' designate legs situated on the bed 2 and supporting a tank 3. To the tank 3 are connected a first pipe 6 for supplying a paper material, a water supply pipe 7 through which water is supplied from a later-mentioned rotational member 19, e.g., an impeller, to a primary chamber 15 defined in the tank 3, and a discharge pipe 8 for discharging the paper material from the primary chamber 15 by the rotational member, e.g., impeller. The water supply pipe 7 is provided with a water supply valve 10, while the discharge pipe 8 is provided with a discharge valve 10'.

The space inside the tank 3 is divided into the above-mentioned first chamber 15 and another chamber, i.e., a second chamber 16, by means of a cylindrical screen 14 mounted in the tank 3. Although not illustrated in detail, the cylindrical screen 14 may have a multiplicity of circular apertures or may be of a slit-type screen.

A cylindrical rotary member 9 is carried by a rotary shaft 92 and is disposed in the primary chamber 15 so as to oppose the cylindrical screen 14. A multiplicity of projections 91 is provided on the surface of the cylindrical rotary member 9 and is arranged in a spiral manner.

The aforementioned rotational member 19, e.g., an impeller, is carried by the same shaft 92 as that carries the cylindrical rotary member 9 and is disposed near the end of the cylindrical rotary member 9 remote from the paper material receiving end **3*a* of the tank 3. The rotary shaft 92 is driven by a motor 23 through a belt 24**.

In the illustrated embodiment, the rotary shaft 92 is disposed horizontally, and the longitudinal axis of the cylindrical rotary member extends parallel to the rotary shaft 92.

In operation, a paper material pooled in another tank 11 is supplied by a pump 12 into the tank 3 via the first pipe 6. As the motor 23 is started while the paper material is accumulated in the tank 3, the rotary shaft 92 is driven through the belt 24, so that the cylindrical rotary member 9 is rotated at a peripheral speed of, for example, 20 m/sec or higher, together with the rotational member 19 such as impeller. Heavy components of the paper material are accumulated in a sedimentation chamber **3*b***.

During rotation of the cylindrical rotary member 9, a large dissociation force is imparted to the paper material by the portions having high peripheral velocities, i.e., the projections 91, so that the paper material in the tank 3 is efficiently screened and refined by the screen 14.

The concentration of the paper material in the material liquid or slurry is high in the region near the rotational member 19 such as impeller. However, as a pump 27 is started while the water supply valve 10 is opened and the discharge valve 10' is closed, by means of a controller 100 or by a manual operation, water is supplied from the end near the rotational member 19 into the primary chamber 15 in the tank 3 through the water supply pipe 7, so that the material liquid or slurry is diluted by this water. At the same time, a state resembling "scrambling washing" is created due to collision between the water supplied into the primary chamber 15 in the tank 3 and the paper material supplied by the cylindrical rotary member 9. Consequently, vinyl-coated paper such as a milk carton supplied as the paper material is dissociated so that paper component is separated from the vinyl coating layer. When discharge of the paper material from the discharge pipe 8 is required, the discharge valve 10' is opened and the water supply valve 10 is preferably opened although it may be closed, by the operation of a timer in the controller 100 or by a manual work. When the timer control is used, the discharge valve 10' is preferably intermittently opened and closed, e.g., opened for 30 seconds after a closing period of 20 minutes or so.

The paper material screened and refined through the screen 14 is discharged through a discharge pipe 25 connected to the secondary chamber 16.

Foreign matters which could not be passed through the screen 14, such as vinyl, hot melt, plastics and dust, are moved together with the remaining paper material towards the end remote from the paper material receiving end 3a.

When the water supply valve 10 is opened while the discharge valve 10' is closed, water supplied from the end near the rotational member 19 into the primary chamber 15 in the tank 3 flows backward towards the paper receiving end 3*a* so as to collide with the paper material supplied by the cylindrical rotary member 9, thereby creating a state resembling "scrambling washing".

As a result of the "scrambling washing", the paper material is dissociated into foreign matters and effective paper components and then diluted. The effective paper components are discharged through the discharge pipe 26 past the screen 14.

The foreign matters which could not pass through the screen 14 is accumulated at the end remote from the paper material receiving end 3*a* of the tank 3 as the time elapses. The accumulated foreign matters are then discharged through the discharge pipe 8 into a waste box 28. When discharge of the foreign matters through the discharge pipe 8 is required, the discharge valve 10' is opened and the water supply valve 10 is preferably opened although it may be closed, by the operation of a timer in the controller 100 or by a manual work. When the timer control is used, the discharge valve 10' is preferably intermittently opened and closed, e.g , opened for 30 seconds after a closing period of 20 minutes or so.

When the state of the discharge valve 10' is controlled by the timer, it is necessary that the timer is set in such a manner as to minimize wasting of useful paper components. In the illustrated embodiment, the secondary chamber 16 is divided by a partition wall 16' into two sections and different discharge pipes 25 and 26 are connected to these sections so as to collect useful paper components of different levels of quality. This, however, is only illustrative and the partition wall 16' may be omitted, i.e., such that only one discharge pipe is used.

Figure 2:
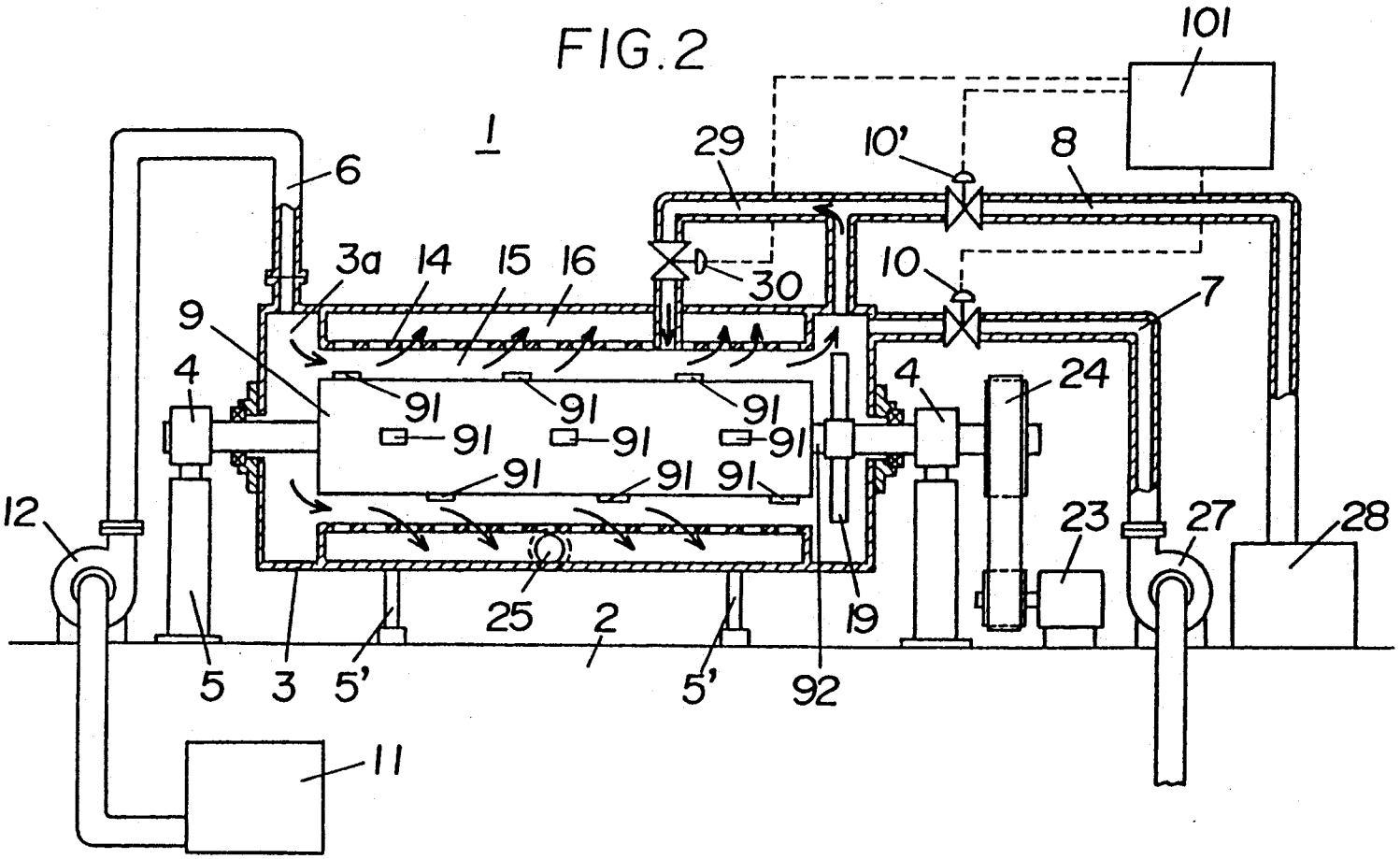
FIG. 2 is a partly-sectioned schematic illustration of another embodiment of the paper material refining apparatus in accordance with the present invention.

FIG. 2 shows a second embodiment of the paper material screening/refining apparatus in accordance with the invention. In FIG. 2, the same reference numerals are used to denote the same parts or members as those shown in FIG. 1. The paper material screening/refining apparatus, generally designated at 1, has a tank 3 for receiving and storing a paper material, a cylindrical screen 14 which divides the space inside the tank 3 into a primary chamber 15 and a secondary chamber 16, a cylindrical rotary member 9 carried by a rotary shaft 92 and disposed so as to oppose the screen 14, a rotational member 19 such as an impeller carried by the rotary shaft 92 and disposed in the end of the tank 3 remote from the paper material receiving end 3*a* of the tank 3, a water supply pipe 7 for supplying water from the end near the tank 3 into the primary chamber 15, a water supply valve 10 provided in the water supply pipe 7, a water discharge pipe 8 for discharging the paper material in the primary chamber 15 from the end of the tank 3 near the rotational member 19, a recirculation passage 29 interconnecting the discharge pipe 8 and the primary chamber 15, a recirculation valve 30 provided in the recirculation passage 29, and a discharge valve 10' provided in a portion of the discharge pipe 8 which does not form any part of the recirculation passage 29.

The rotary shaft 92 is laid horizontally, and the longitudinal axis of the cylindrical rotary member 9 extends parallel to the rotary shaft 92.

The water supply valve 10, discharge valve 10' and the recirculation valve 30 are controlled by a timer of a controller 101 or by manual operation. When the timer is used, the discharge valve 10' is opened and closed intermittently, such that, for example, the discharge valve 10' is switched from close state to open state after 20-minute closing of the water supply valve 10 and the recirculation valve 30.

In operation, a paper material pooled in another tank 11 is supplied by a pump 12 into the tank 3 via the first pipe 6. As the motor 23 is started while the paper material is accumulated in the tank 3, the rotary shaft 92 is driven through the belt 24, so that the cylindrical rotary member 9 is rotated at a peripheral speed of, for example, 20 m/sec or higher, together with the rotational member 19 such as impeller.

During rotation of the cylindrical rotary member 9, a large dissociation force is imparted to the paper material by the portions having high peripheral velocities, i.e., the projections 91, so that the paper material in the tank 3 is efficiently screened and refined by the screen 14.

The concentration of the paper material in the material liquid or slurry is high in the region near the rotational member 19 such as impeller. However, as a pump 27 is started while the water supply valve 10 and the recirculation valve 30 are opened and the discharge valve 10' is closed by means of the controller 101 or by a manual operation, water is supplied from the end near the rotational member 19 into the primary chamber 15 in the tank 3 through the water supply pipe 7, so that the material liquid or slurry is diluted by this water. At the same time, the diluted material liquid or slurry is recirculated through the recirculation passage 29 as shown in FIG. 2. Consequently, the paper material is repeatedly agitated for dissociation, so as to be efficiently screened and refined by the screen 14.

Foreign matters which could not be passed through the screen 14 are progressively moved together with the remaining paper material towards the end remote from the paper material receiving end 3*a*. Such foreign materials are discharged through the discharge pipe 8 into the waste box 28 as the discharge valve 10' is opened.

When discharge of the paper material through the discharge pipe 8 is required, the discharge valve 10' is opened while the water supply valve 10 and the recirculation valve 30 are preferably opened and closed, respectively, although these valves 10 and 30 may be closed and opened, respectively, by the operation of a timer in the controller 101 or by a manual work. When the timer control is used, the discharge valve 10' is preferably intermittently opened and closed, e.g., opened for 30 seconds after a closing period of 20 minutes or so.

When the state of the discharge valve 10' is controlled by the timer, it is necessary that the timer is set in such a manner as to minimize wasting of useful paper components. In the second embodiment now described, as well as in the preceding embodiment, it is possible to eliminate reject screen by setting the controller 101 to minimize the amount for wasting of the useful paper components.

As has been described, the present invention in one aspect provides a paper material screening and refining apparatus, comprising: a tank which receives a paper material to allow the paper material to accumulate therein; a cylindrical screen which divides the space in the tank into a primary chamber and a secondary chamber; a cylindrical rotary member carried by a rotary shaft and disposed so as to oppose to the screen; a rotational member carried by the rotary shaft and disposed near the end of the tank remote from the paper material receiving end of the tank; a water supply pipe for supplying water into the primary chamber from the region near the rotational member; a water supply valve provided in the water supply pipe; a discharge pipe for discharging the paper material in the primary chamber of the tank from a region near the rotational member; and a discharge valve provided in the discharge pipe. Water is introduced into the primary chamber from a region near the rotational member, so as to dilute the material liquid or slurry and to provide a state resembling "scrambling washing" as a result of collision between the introduced water and the paper material, thus promoting dissociation of the paper material, whereby the paper material is efficiently screened and refined by the screen.

According to another aspect, the invention provides a paper material screening and refining apparatus, comprising: a tank which receives a paper material to allow the paper material to accumulate therein; a cylindrical screen which divides the space in the tank into a primary chamber and a secondary chamber; a cylindrical rotary member carried by a rotary shaft and disposed so as to oppose to the screen; a rotational member carried by the rotary shaft and disposed near the end of the tank remote from the paper material receiving end of the tank; a water supply pipe for supplying water into the primary chamber from the region near the rotational member; a water supply valve provided in the water supply pipe; a discharge pipe for discharging the paper material in the primary chamber of the tank from a region near the rotational member; a recirculation passage interconnecting the discharge pipe and the primary chamber; a recirculation valve provided in the recirculation passage; and a discharge valve provided in a portion of the discharge pipe which does not constitute any part of the recirculation passage. The thickness or density of the paper material progressively increases towards the end adjacent to the rotational member, as a result of the screening of the material by the cooperation between the cylindrical rotary member and the cylindrical screen. However, as the water supply valve and the recirculation valve are set to open states while the discharge valve is set to close state, water is introduced into the primary chamber from the region near the rotational member so as to dilute the material liquid or slurry. At the same time, the paper material is repeatedly agitated and dissociated as a result of recirculation, so that the paper material can be efficiently screened and refined.

What is claimed is:

1. A paper material screening and refining apparatus, comprising:

an elongated tank having first and second side portions located away from each other in a longitudinal direction of the tank, an inlet formed at the first side portion for supplying a paper material into the tank, said paper material containing foreign components and paper components, a cylindrical screen situated inside the tank to divide the tank into a primary chamber and a secondary chamber, said paper material being supplied to the primary chamber to be separated into the foreign components and the paper components, said paper components being removed from the primary chamber through the secondary chamber, a cylindrical rotary member disposed inside the primary chamber of the tank to oppose to the screen and having a shaft, a rotational member attached to the shaft near the second side portion, said rotational member being rotated together with the rotary member when the shaft is rotated, a water supply pipe disposed at the second side portion for supplying water to the tank from the second side portion and having a water supply valve, and a controller for controlling the water supply valve, said water supply valve being opened intermittently by the controller to supply water into the tank from the second side portion through said water supply pipe so that the paper material, which is gradually transferred from the first side portion to the second side portion as the rotary member is rotated when water is not supplied through the water supply pipe, is pushed back to the first side portion by water supplied from the water supply pipe while colliding with the paper material transferred from the first side portion to thereby substantially completely separate the paper components from the foreign components and to discharge the paper components through the secondary chamber.

2. A paper material screening and refining apparatus according to claim 1 further comprising a discharge pipe formed at the second side portion, said foreign components separated from the paper components and accumulated at the second side portion being discharged from the discharge pipe.

3. A paper material screening and refining apparatus according to claim 2, wherein the secondary chamber is located radially outwardly of the primary chamber.

4. A paper material screening and refining apparatus according to claim 3, further comprising a discharge valve formed at the discharge pipe and controlled by said controller.

5. A paper material screening and refining apparatus according to claim 4, wherein said controller opens the water supply valve and the discharge valve when the foreign components at the second side portion are discharge through the discharge pipe.

6. A paper material screening and refining apparatus according to claim 4, further comprising a recirculation passage interconnecting the second side portion and a middle of the primary chamber between the first and second side portions so that the paper material accumulated at the second side portion is again returned to the middle of the tank for refining, and a recirculation valve provided at the recirculation passage for controlling recirculation.

7. A paper material screening and refining apparatus according to claim 6, wherein said water supply valve is opened when the recirculation valve is opened so that the paper material at the second side portion is diluted for circulation.

8. A paper material screening and refining apparatus according to claim 2, wherein said water supply pipe is located at an end wall of the tank to orient toward the first side portion.

9. A paper material screening and refining apparatus according to claim 8, wherein said discharge pipe has an inlet hole at the tank, said inlet hole being located at a portion radially outwardly of the rotational member.

* * * * *